US011646516B2

(12) United States Patent
Hata

(10) Patent No.: US 11,646,516 B2
(45) Date of Patent: May 9, 2023

(54) PRESS-FIT TERMINAL

(71) Applicant: KYOCERA CORPORATION, Kyoto (JP)

(72) Inventor: Tetsuya Hata, Yokohama (JP)

(73) Assignee: KYOCERA CORPORATION, Kyoto (JP)

( * ) Notice: Subject to any disclaimer, the term of this patent is extended or adjusted under 35 U.S.C. 154(b) by 137 days.

(21) Appl. No.: 17/425,920

(22) PCT Filed: Jan. 29, 2020

(86) PCT No.: PCT/JP2020/003267
§ 371 (c)(1),
(2) Date: Jul. 26, 2021

(87) PCT Pub. No.: WO2020/158827
PCT Pub. Date: Aug. 6, 2020

(65) Prior Publication Data

US 2022/0166156 A1 May 26, 2022

(30) Foreign Application Priority Data

Jan. 29, 2019 (JP) ..... JP2019-012814

(51) Int. Cl.
*H01R 12/58* (2011.01)

(52) U.S. Cl.
CPC ..... *H01R 12/585* (2013.01)

(58) Field of Classification Search
CPC ..... H01R 12/716; H01R 12/58; H01R 12/585
See application file for complete search history.

(56) References Cited

U.S. PATENT DOCUMENTS

| | | | | |
|---|---|---|---|---|
| 9,093,780 | B2 * | 7/2015 | Miyake | H01R 12/585 |
| 10,734,740 | B2 * | 8/2020 | Yamanaka | H01R 12/585 |
| 2003/0114027 | A1 * | 6/2003 | Wurster | H05K 3/366 439/82 |
| 2009/0023310 | A1 * | 1/2009 | Thiel | H01R 12/585 439/66 |
| 2018/0083377 | A1 * | 3/2018 | Yamanaka | H01R 12/7064 |

(Continued)

FOREIGN PATENT DOCUMENTS

JP 2016-201329 A 12/2016

*Primary Examiner* — Truc T Nguyen
(74) *Attorney, Agent, or Firm* — Duane Morris LLP

(57) ABSTRACT

A press-fit terminal includes a contact portion that is to be in contact with an inner wall of a through hole provided in a substrate; a leading end portion disposed on a leading end side relative to the contact portion in an insertion direction toward the through hole; a base portion disposed on an opposite side to the leading end portion with the contact portion being interposed between the leading end portion and the base portion; a penetration hole provided across the base portion, the contact portion, and the leading end portion; and a first inclination portion provided across the contact portion and the leading end portion and disposed continuous at an outer periphery of the penetration hole. The first inclination portion is inclined toward the penetration hole. The length, in a width direction, of at least part of the first inclination portion increases toward a leading end of the leading end portion, the width direction being orthogonal to the insertion direction and a penetration direction.

12 Claims, 9 Drawing Sheets

(56) References Cited

U.S. PATENT DOCUMENTS

| | | | | |
|---|---|---|---|---|
| 2019/0280406 | A1* | 9/2019 | Zhang | H01R 12/585 |
| 2020/0274294 | A1* | 8/2020 | Lynch | H01R 13/405 |
| 2022/0400557 | A1* | 12/2022 | Lewis | B23K 1/20 |

* cited by examiner

PRESS-FIT TERMINAL

TECHNICAL FIELD

The present invention relates to a press-fit terminal.

BACKGROUND ART

There is known a press-fit terminal that is held in a through hole provided in a substrate of electronic equipment. The press-fit terminal is press fitted into the through hole, and is held by a reaction force received from the inner wall of the through hole. Patent Document 1 describes one example of the press-fit terminal.

CITATION LIST

Patent Literature

Patent Document 1: JP 2016-201329 A

SUMMARY OF INVENTION

A press-fit terminal according to one aspect includes a contact portion that is to be in contact with an inner wall of a through hole provided in a substrate; a leading end portion disposed on a leading end side relative to the contact portion in an insertion direction toward the through hole; a base portion disposed on an opposite side to the leading end portion with the contact portion being interposed between the leading end portion and the base portion; a penetration hole provided across the base portion, the contact portion, and the leading end portion; and a first inclination portion provided across the contact portion and the leading end portion and disposed continuous at an outer periphery of the penetration hole, in which the first inclination portion is inclined toward the penetration hole, and a length, in a width direction, of at least part of the first inclination portion increases toward a leading end of the leading end portion, the width direction being orthogonal to the insertion direction and a penetration direction of the penetration hole.

DESCRIPTION OF EMBODIMENTS

Below, an embodiment of a press-fit terminal according to the present disclosure will be described with reference to the drawings. Note that the embodiment described below is not intended to limit the present invention. Furthermore, constituent elements in the embodiment described below include those that can be easily replaced by a person skilled in the art and include those that are substantially identical.

An XYZ Cartesian coordinate system is used in the following description. The Z axis is an axis parallel to an insertion direction in which a press-fit terminal 100 is inserted into a through hole 201. The Y axis is an axis parallel to a penetration direction of a penetration hole 50 of the press-fit terminal 100. The X axis is an axis orthogonal to both the Y axis and the Z axis. A direction extending along the X axis is referred to as an X direction. A direction extending along the Y axis is referred to as a Y direction. A direction extending along the Z axis is referred to as a Z direction.

The X direction is a width direction of the press-fit terminal 100. The Y direction is a thickness direction of the press-fit terminal 100. The Y direction is a penetration direction of the penetration hole 50. The Z direction is a longitudinal direction of the press-fit terminal 100. The Z direction is a direction orthogonal to a substrate 200. Of the Z direction, a direction (insertion direction) in which the press-fit terminal 100 moves when being inserted into a through hole 201 is referred to as a +Z direction. A direction opposite to the +Z direction is referred to as a −Z direction.

Embodiment

Figure 1:
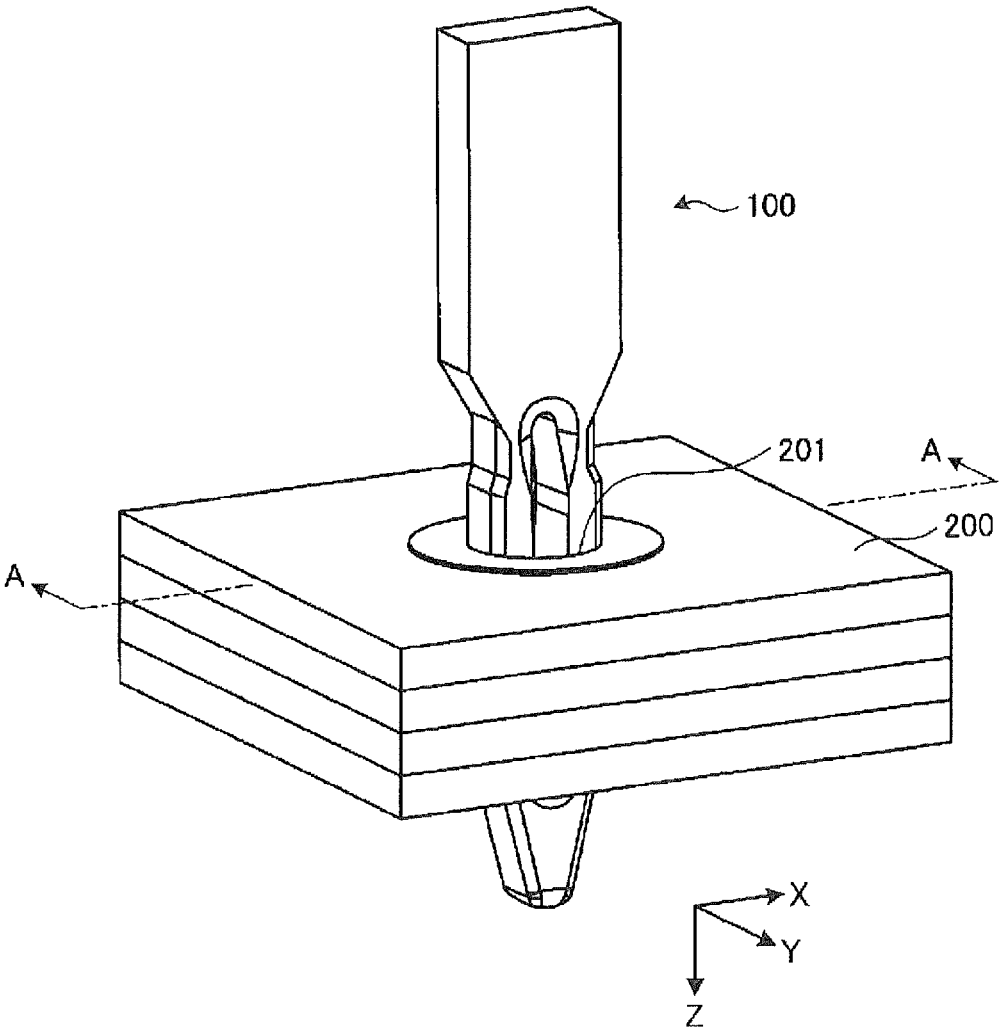
FIG. 1 is a perspective view of a press-fit terminal and a substrate according to an embodiment.
Figure 2:
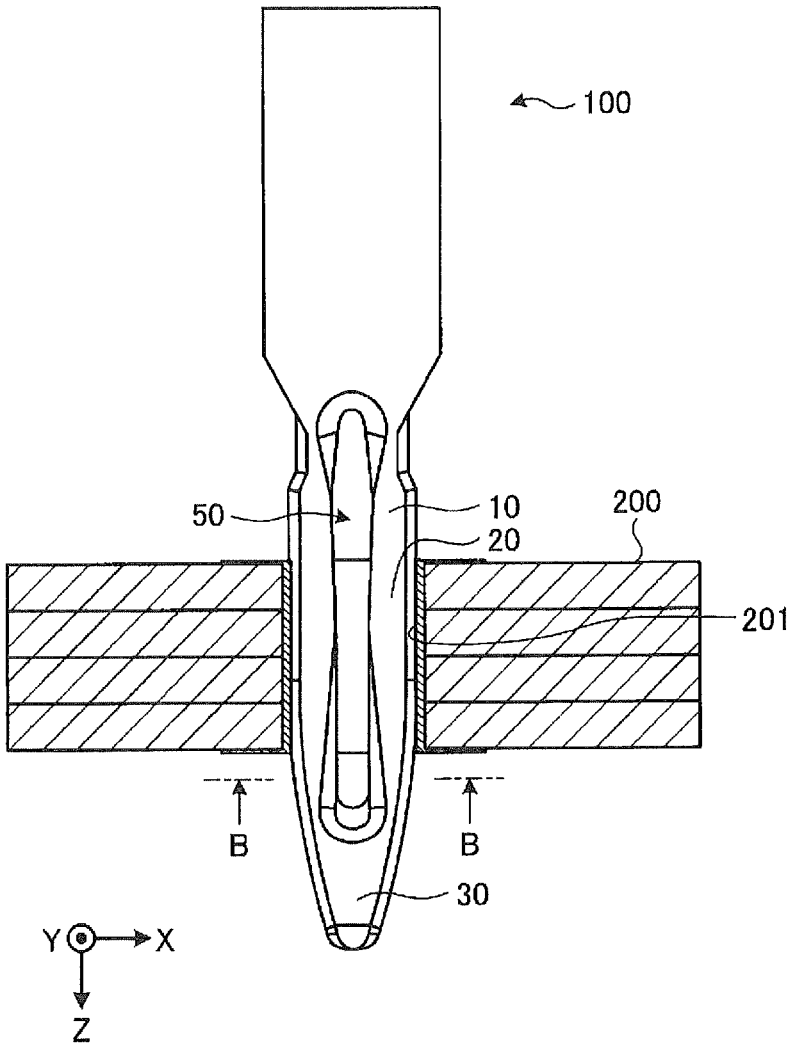
FIG. 2 is a cross-sectional view taken along the line A-A in FIG. 1.
Figure 3:
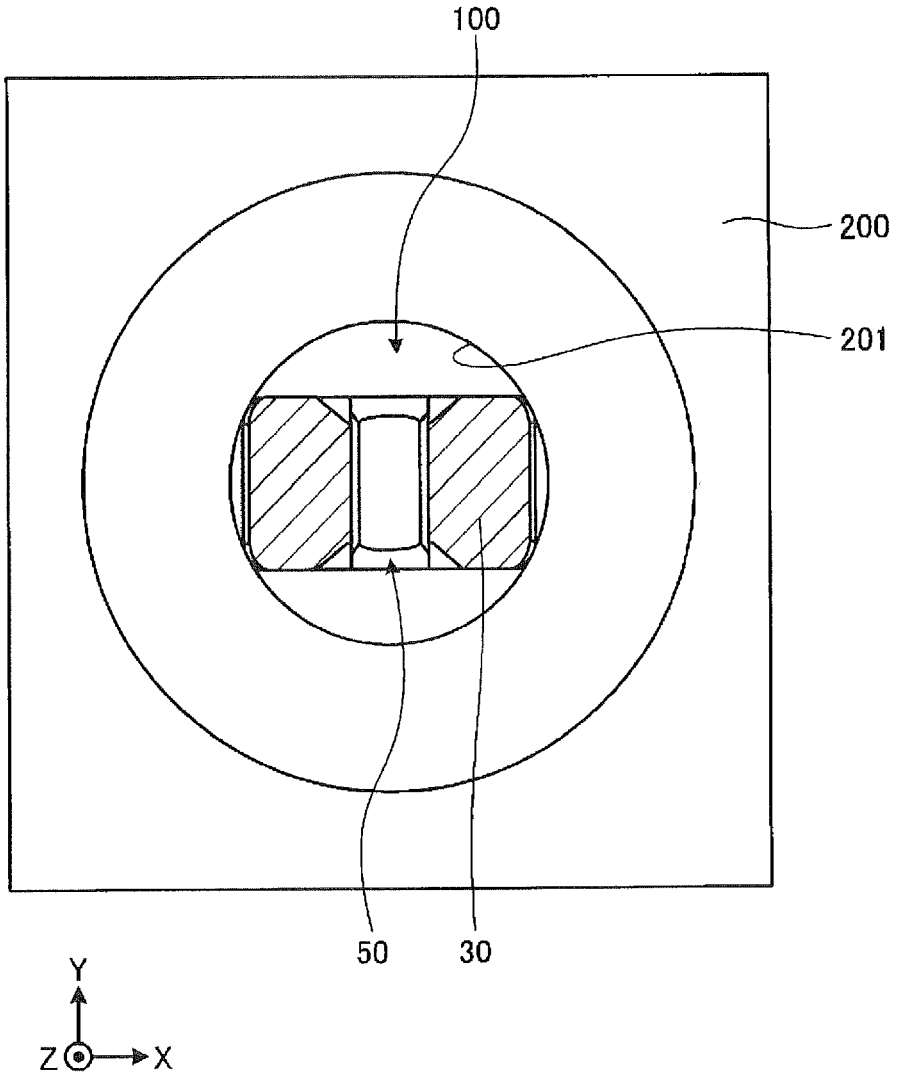
FIG. 3 is a cross-sectional view taken along the line B-B in FIG. 2.
Figure 4:
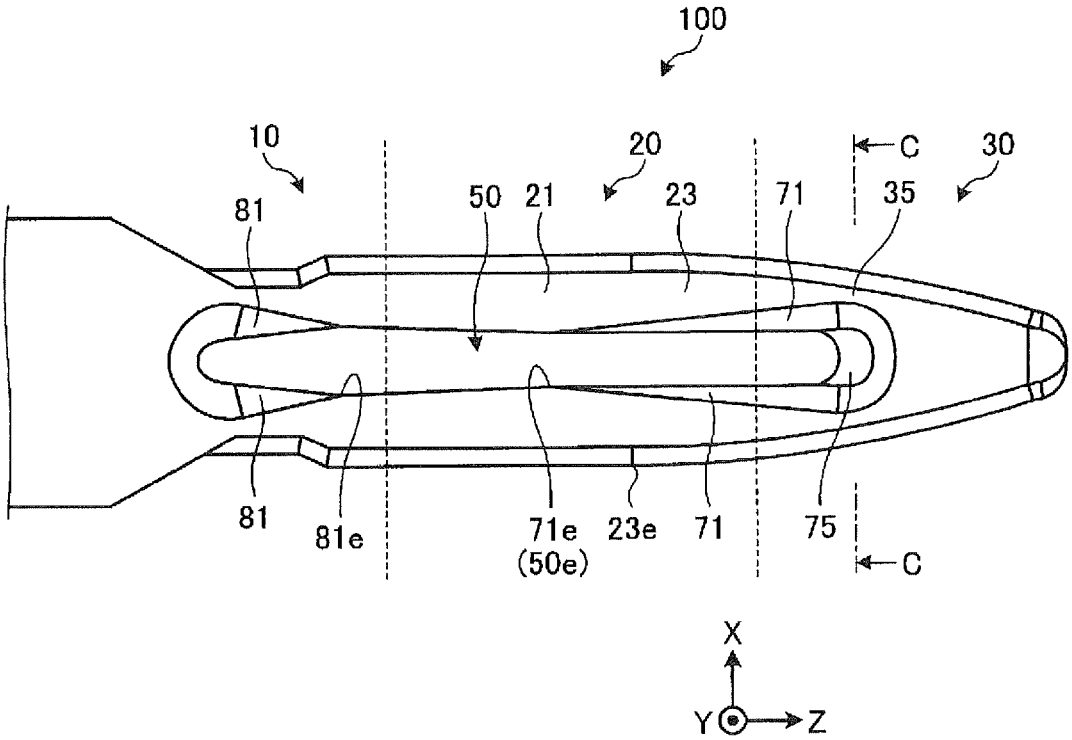
FIG. 4 is a front view of the press-fit terminal according to the embodiment.
Figure 5:
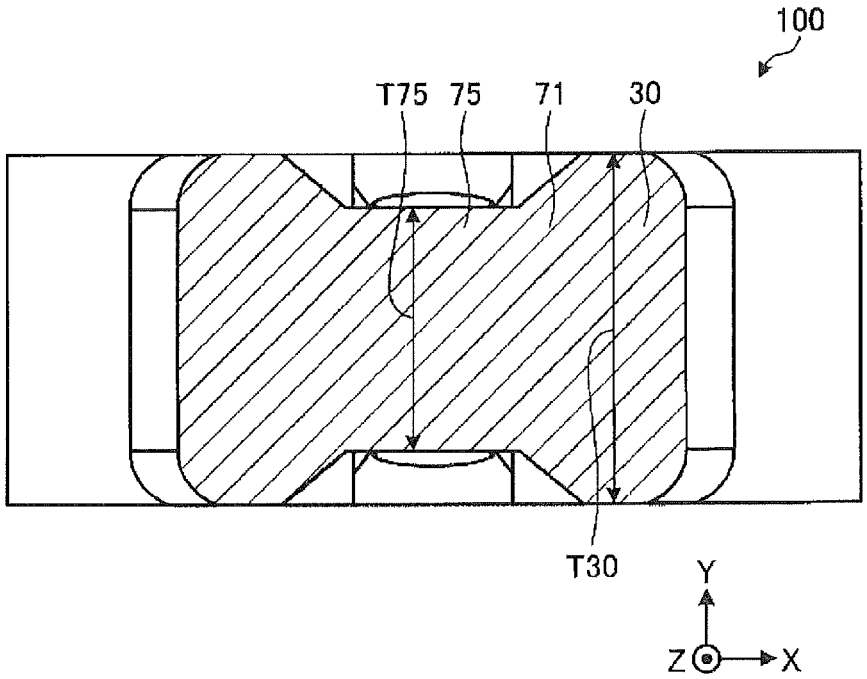
FIG. 5 is a cross-sectional view taken along the line C-C in FIG. 4.

FIG. 1 is a perspective view of the press-fit terminal and a substrate according to the embodiment. FIG. 2 is a cross-sectional view taken along the line A-A in FIG. 1. FIG. 3 is a cross-sectional view taken along the line B-B in FIG. 2. FIG. 4 is a front view of the press-fit terminal according to the embodiment. FIG. 5 is a cross-sectional view taken along the line C-C in FIG. 4. Note that, in FIG. 2, the press-fit terminal 100 is illustrated in a front view. The dotted line in FIG. 4 indicates the position of the front surface of the substrate 200.

As illustrated in FIG. 1, the press-fit terminal 100 according to the embodiment is to be mounted in a through hole 201 provided in the substrate 200. The press-fit terminal 100 is press fitted into the through hole 201. The substrate 200 is, for example, a printed circuit board made of glass epoxy, and is a multi-layer substrate. The through hole 201 is a hole that penetrates all the layers of the substrate 200. The substrate 200 includes a plurality of through holes 201. The plurality of through holes 201 are insulated from each other. Metal plating is applied on the inner wall and periphery of the through hole 201. The metal includes, for example, a copper alloy. However, the metal is not particularly limited to the copper alloy. The substrate 200 includes a plurality of electronic components. Note that the substrate 200 may be a glass polyimide substrate or fluorine substrate, in addition to the glass epoxy substrate.

As illustrated in FIG. 4, the press-fit terminal 100 includes a contact portion 20, a leading end portion 30, a base portion 10, a penetration hole 50, a first inclination portion 71, a thin portion 75, and a second inclination portion 81. The base portion 10, the contact portion 20, and the leading end portion 30 are disposed in this order in the +Z direction. The base portion 10, the contact portion 20, the leading end portion 30, the first inclination portion 71, the thin portion 75, and the second inclination portion 81 are integrally formed using a metal. The metal includes, for example, a copper alloy. However, the metal is not particularly limited to the copper alloy. Specifically, the press-fit terminal 100 is formed by pressing a plate member made of metal. Undercoat and surface layer plating are applied on the metal front surface of the press-fit terminal 100. Ni or Sn-base may be used for the undercoat. Sn-base or Au may be used for the surface layer plating. Note that it may be possible to employ a configuration in which the front layer plating alone may be applied without the undercoat.

As illustrated in FIG. 2, in a state where the press-fit terminal 100 is mounted in the through hole 201, the contact portion 20 is disposed on the inner side of the through hole 201. The contact portion 20 is in contact with the inner wall of the through hole 201. The contact portion 20 presses the inner wall of the through hole 201 with elastic deformation.

As illustrated in FIG. 4, the contact portion 20 includes a main body portion 21 and a reduced portion 23. The main body portion 21 and the reduced portion 23 are disposed in this order in the +Z direction. That is, the reduced portion 23 is disposed in the +Z direction relative to the main body portion 21. The length of the main body portion 21 in the X direction is constant. The length of the reduced portion 23 in the X direction decreases in the +Z direction. The outer peripheral surface of the reduced portion 23 has a curved surface shape. In an XZ plan view (as viewed from the Y direction), the outer edge of the reduced portion 23 traces an arc shape.

As illustrated in FIG. 2, in a state where the press-fit terminal 100 is mounted in the through hole 201, the leading end portion 30 is disposed outside of the through hole 201. The leading end portion 30 sticks out from the through hole 201 in the +Z direction.

As illustrated in FIG. 4, the leading end portion 30 is disposed in the +Z direction relative to the contact portion 20. The length of the leading end portion 30 in the X direction decreases in the +Z direction. The outer peripheral surface of the leading end portion 30 has a curved surface shape. In an XZ plan view (as viewed from the Y direction), the outer edge of the leading end portion 30 traces an arc shape.

As illustrated in FIG. 2, in a state where the press-fit terminal 100 is mounted in the through hole 201, the base portion 10 is disposed outside of the through hole 201. The base portion 10 protrudes from the through hole 201 in the −Z direction.

As illustrated in FIG. 4, the base portion 10 is disposed in the −Z direction relative to the contact portion 20. The base portion 10 is disposed on an opposite side to the leading end portion 30 with the contact portion 20 being interposed between the base portion 10 and the leading end portion 30. The base portion 10 is connected to an electronic component or the like serving as a target object to be electrically connected to the substrate 200. The electronic component and the substrate 200 are electrically connected to each other through the base portion 10 and the contact portion 20.

As illustrated in FIG. 4, the penetration hole 50 extends through the press-fit terminal 100 in the thickness direction. The penetration hole 50 is provided across the base portion 10, the contact portion 20, and the leading end portion 30. An end portion of the penetration hole 50 in the −Z direction is disposed in the base portion 10. An end portion of the penetration hole 50 in the +Z direction is disposed in the leading end portion 30. The length of the penetration hole 50 in the X direction is constant from a portion corresponding to the contact portion 20 to a portion corresponding to the leading end portion 30. The length of the penetration hole 50 in the X direction increases from a portion corresponding to the contact portion 20 to a portion corresponding to the base portion 10. In a portion corresponding to the base portion 10, the length of the penetration hole 50 in the X direction decreases in the −Z direction.

As illustrated in FIG. 4, the first inclination portion 71 is provided across the contact portion 20 and the leading end portion 30. The first inclination portion 71 is disposed on the penetration hole 50 side of the contact portion 20 and the leading end portion 30. That is, the first inclination portion 71 is disposed on the inner side of the contact portion 20 and the leading end portion 30. The first inclination portion 71 faces the penetration hole 50. That is, the first inclination portion 71 is formed continuous at the outer periphery of the penetration hole 50. As illustrated in FIG. 5, the thickness of the first inclination portion 71 in the Y direction decreases toward the penetration hole 50. The first inclination portion 71 includes an inclined surface angled relative to the XZ plane.

As illustrated in FIG. 4, the first inclination portion 71 includes a portion of which the length in the X direction increases in the +Z direction. In other words, the length, in the X direction, of at least part of the first inclination portion 71 increases in the +Z direction. An end portion 71*e* of the first inclination portion 71 in the −Z direction is disposed in the contact portion 20. The end portion 71*e* of the first inclination portion 71 is disposed in the +Z direction (the leading end portion 30 side) relative to the end portion of the contact portion 20 on the base portion 10 side in the Z direction. The end portion 71*e* of the first inclination portion 71 is disposed in the −Z direction relative to an end portion 23*e* of the reduced portion 23 in the −Z direction. The position, in the Z direction, of the end portion 71*e* of the first inclination portion 71 is equal to the position, in the Z direction, of a bent portion 50*e* of the penetration hole 50. The bent portion 50*e* is an end portion, in the −Z direction, of a portion of the penetration hole 50 that has a constant width in the X direction.

As illustrated in FIG. 4, the press-fit terminal 100 includes two first inclination portions 71. One of the first inclination portions 71 is disposed on one side in the X direction relative to the penetration hole 50. The other one of the first inclination portions 71 is disposed on the other side in the X direction relative to the penetration hole 50. That is, the first inclination portions 71 are each disposed on a corresponding one of both sides of the penetration hole 50 in the X direction. The two first inclination portions 71 are coupled to each other at a position (at a position of the leading end portion 30) located in the +Z direction from the penetration hole 50.

As illustrated in FIG. 4, the thin portion 75 is disposed between the first inclination portion 71 and the end portion of the penetration hole 50 in the +Z direction. That is, the thin portion 75 is disposed on the inner side of the first inclination portion 71. As illustrated in FIG. 5, a thickness T75 of the thin portion 75 in the Y direction is smaller than a thickness T30 of the leading end portion 30 in the Y direction. The thickness T75 of the thin portion 75 is constant. The thin portion 75 includes a front surface parallel to the XZ plane.

As illustrated in FIG. 4, the second inclination portion 81 is provided over the contact portion 20 and the base portion 10. The second inclination portion 81 is disposed so as to be spaced apart in the Z direction from the first inclination portion 71. The second inclination portion 81 is disposed on the penetration hole 50 side of the contact portion 20 and the base portion 10. That is, the second inclination portion 81 is disposed on the inner side of the contact portion 20 and the base portion 10. The second inclination portion 81 faces the penetration hole 50. That is, the second inclination portion 81 is formed continuous at the outer periphery of the penetration hole 50. The thickness of the second inclination portion 81 in the Y direction decreases toward the penetration hole 50. The second inclination portion 81 includes an inclined surface angled relative to the XZ plane.

As illustrated in FIG. 4, the second inclination portion 81 includes a portion of which the length in the X direction increases in the −Z direction. That is, the length, in the X direction, of at least part of the second inclination portion 81 increases in the −Z direction. An end portion 81*e* of the second inclination portion 81 in the +Z direction is disposed in the −Z direction relative to the contact portion 20. That is, the end portion 81*e* of the second inclination portion 81 is disposed in the base portion 10.

As illustrated in FIG. 4, the press-fit terminal 100 includes two second inclination portions 81. One of the second inclination portions 81 is disposed on one side in the X direction relative to the penetration hole 50. The other one of the second inclination portions 81 is disposed on the other side in the X direction relative to the penetration hole 50. That is, the second inclination portions 81 are each disposed on a corresponding one of both sides of the penetration hole 50 in the X direction. The two second inclination portions 81 are coupled to each other at a position (position of the base portion 10) located in the −Z direction from the penetration hole 50.

At the time of mounting the press-fit terminal 100 in the through hole 201, the leading end portion 30 is first inserted into the through hole 201. Then, the contact portion 20 reaches the through hole 201. In a state where the contact portion 20 is in contact with the through hole 201, the press-fit terminal 100 is press fitted. As the press-fit terminal 100 includes the penetration hole 50, it is possible to easily achieve elastic deformation at the time of the press fitting. The contact portion 20 enters the through hole 201 while being elastically deformed. Once the contact portion 20 has been inserted into the through hole 201, the press fitting ends. The press-fit terminal 100 is elastically deformed in a state of being mounted in the through hole 201. Since the contact portion 20 presses the inner wall of the through hole 201, friction occurs between the contact portion 20 and the inner wall of the through hole 201. This enables the press-fit terminal 100 to be held with respect to the through hole 201.

Note that the two first inclination portions 71 need not be necessarily coupled to each other. The two second inclination portions 81 need not be necessarily coupled to each other. In addition, the press-fit terminal 100 need not include the second inclination portions 81. The press-fit terminal 100 need not include the thin portion 75.

As described above, the press-fit terminal 100 includes the contact portion 20, the leading end portion 30, the base portion 10, the penetration hole 50, and the first inclination portion 71. The contact portion 20 is to be in contact with the inner wall of the through hole 201 provided in the substrate 200. The leading end portion 30 is disposed on a leading end side relative to the contact portion 20 in the insertion direction (+Z direction) toward the through hole 201. The base portion 10 is disposed on an opposite side to the leading end portion 30 with the contact portion 20 being interposed between the base portion 10 and the leading end portion 30. The penetration hole 50 is provided across the base portion 10, the contact portion 20, and the leading end portion 30. The first inclination portion 71 is provided across the contact portion 20 and the leading end portion 30, and is disposed continuous at the outer periphery of the penetration hole 50. The first inclination portion 71 is inclined toward the penetration hole 50. The length, in the width direction (X direction), of at least part of the first inclination portion 71 increases toward the leading end of the leading end portion 30, the width direction being orthogonal to the insertion direction (+Z direction) and the penetration direction (Y direction) of the penetration hole 50.

For example, at the time of inserting the press-fit terminal as described in Patent Document 1 into a through hole, a large force may act on the inner wall of the through hole. Due to the force applied by the press-fit terminal on the inner wall of the through hole, delamination may occur between layers of the substrate, which may result in whitening. This causes a reduction in the actual distance between adjacent through holes, which results in a reduction in insulation resistance between adjacent through holes. In order to suppress an insulation failure, it is desirable to reduce the force applied to the through hole at the time of inserting the press-fit terminal into the through hole. On the other hand, after the press-fit terminal is inserted into the through hole, it is desired that the press-fit terminal not easily fall out of the through hole.

In contrast, the press-fit terminal 100 according to the present embodiment includes the first inclination portion 71 as described above. This first inclination portion 71 reduces the cross-sectional secondary moment of the press-fit terminal 100 in the XY plane (the cross-sectional secondary moment about the X axis and the cross-sectional secondary moment about the Y axis). In the present embodiment, the size of the first inclination portion 71 increases toward the leading end portion 30 side, which makes it possible to reduce the cross-sectional secondary moment in the XY plane of the leading end portion 30. This enables the leading end portion 30 side of the press-fit terminal 100 to be easily elastically deformed when the press-fit terminal 100 is inserted into the through hole 201. The press-fit terminal 100 is elastically deformed in a flexible manner, which makes it possible to reduce the force acting on the inner wall of the through hole 201 at the time of insertion. This suppresses whitening of the substrate 200 and makes it possible to maintain the insulation resistance between adjacent through holes 201 of the through holes 201. In addition, the length, in the width direction (X direction), of at least part of the first inclination portion 71 increases toward the leading end of the leading end portion 30. This increases the rigidity of the press-fit terminal 100 after the press-fit terminal 100 is inserted into the through hole 201 to some extent. After the press-fit terminal 100 is inserted into the through hole 201, the elastic deformation of the press-fit terminal 100 is suppressed. This enables the press-fit terminal 100 to be held in the substrate 200. Thus, the press-fit terminal 100 according to the present embodiment can reduce the force acting on the through hole 201 at the time of insertion and can also reduce the likelihood of the press-fit terminal 100 falling out after insertion.

In the press-fit terminal 100, the end portion 71*e* of the first inclination portion 71 on the base portion 10 side is disposed further toward the leading end portion 30 side than the end portion of the contact portion 20 on the base portion 10 side. This improves a balance between the insertion force of the press-fit terminal 100 at the time of insertion of the press-fit terminal 100 into the through hole 201 and the retention force of the press-fit terminal 100 after being inserted into the through hole 201. Thus, the press-fit terminal 100 according to the present embodiment can reduce a force acting on the through hole 201 at the time of insertion and further reduce the likelihood of the press-fit terminal 100 falling out after insertion.

In the press-fit terminal 100, the contact portion 20 includes the main body portion 21 and the reduced portion 23. The length, in the width direction (X direction), of the main body portion 21 is constant. The reduced portion 23 is disposed on the leading end portion 30 side relative to the main body portion 21, and the length of the reduced portion 23 in the width direction (X direction) decreases toward the leading end portion 30. This makes it easy to perform an operation of inserting the press-fit terminal 100 into the through hole 201.

In the press-fit terminal 100, the end portion 71*e* of the first inclination portion 71 on the base portion 10 side is disposed at the base portion 10 side relative to the end portion 23*e* of the reduced portion 23 on the base portion 10 side. This improves a balance between the insertion force of the press-fit terminal 100 at the time of insertion of the press-fit terminal 100 into the through hole 201 and the retention force of the press-fit terminal 100 after being inserted into the through hole 201. Thus, the press-fit terminal 100 according to the present embodiment can reduce a force acting on the through hole 201 at the time of insertion and further reduce the likelihood of the press-fit terminal 100 falling out after insertion.

In the press-fit terminal 100, the first inclination portion 71 is disposed on each of both sides of the penetration hole 50 in the width direction (X direction). The two first inclination portions 71 are coupled to each other at the leading end portion 30. This makes it possible to more easily adjust the rigidity of the press-fit terminal 100 at the time of insertion into the through hole 201. Thus, the press-fit terminal 100 according to the present embodiment can further reduce the force acting on the through hole 201 at the time of insertion.

The press-fit terminal 100 includes the thin portion 75 disposed between the end portion of the penetration hole 50 in the insertion direction (+Z direction) and the first inclination portion 71. An end portion of the thin portion 75 on the penetration hole 50 side (−Z direction) is formed continuous in a circular arc shape in plan view in the Y direction so as not to become a starting point for cracks or the like at the time of insertion. The thickness T75 of the thin portion 75 in the penetration direction (Y direction) is smaller than the thickness T30 of the leading end portion 30 in the penetration direction (Y direction). This enables the press-fit terminal 100 to permit elastic deformation of the leading end portion 30 at the time of insertion while suppressing plastic deformation of an elastic portion 35 (see FIG. 4). Thus, the press-fit terminal 100 can suppress buckling of the leading end portion 30 at the time of insertion into the through hole 201.

The press-fit terminal 100 includes the second inclination portion 81 provided across the contact portion 20 and the base portion 10 and disposed contiguous with the outer periphery of the penetration hole 50. The second inclination portion 81 is inclined toward the penetration hole 50. The length of the second inclination portion 81 in the width direction (X direction) increases in a direction (−Z direction) opposite to a direction toward the leading end of the leading end portion 30. This enables the press-fit terminal 100 to be more easily elastically deformed when being inserted into the through hole 201. In addition, after the press-fit terminal 100 is inserted into the through hole 201, the second inclination portion 81 enables the contact portion 20 of the press-fit terminal 100 to increase the reaction force acting on the inner wall of the through hole 201. That is, it is possible to improve the retention force of the press-fit terminal 100 after the press-fit terminal 100 is inserted into the through hole 201. The press-fit terminal 100 according to the present embodiment can further reduce the force acting on the through hole 201 at the time of insertion, and also further reduce the likelihood of the press-fit terminal 100 falling out after insertion.

In the press-fit terminal 100, the second inclination portion 81 is disposed on each of both sides of the penetration hole 50 in the width direction (X direction). Two second inclination portions 81 are coupled to each other at the base portion 10. This facilitates adjustment of the reaction force that the contact portion 20 of the press-fit terminal 100 applies on the inner wall of the through hole 201 after insertion. Thus, the press-fit terminal 100 according to the present embodiment can further reduce the force acting on the through hole 201 at the time of insertion.

The embodiment according to the present disclosure can be modified without departing from the main point or the scope of the present invention. In addition, the embodiment of the present disclosure and modified examples thereof can be combined as appropriate. For example, the embodiment described above can be modified in the following manner.

First Modified Example

Figure 6:
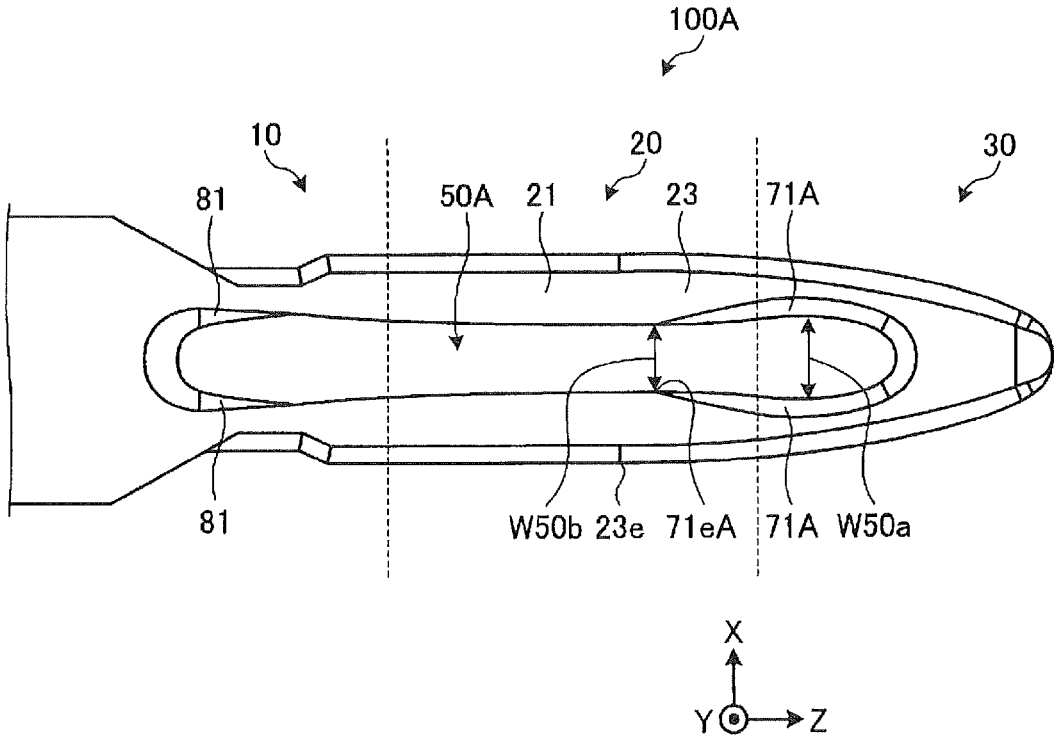
FIG. 6 is a front view of a press-fit terminal according to a first modified example.

FIG. 6 is a front view of a press-fit terminal according to a first modified example. The dotted line in FIG. 6 indicates the position of the front surface of the substrate 200. Note that the same reference characters are attached to constituent elements that are the same as those described in the embodiment described above, and explanation thereof will not be repeated.

As illustrated in FIG. 6, a press-fit terminal 100A according to the first modified example includes a penetration hole 50A and a first inclination portion 71A. The length of the penetration hole 50A in the X direction changes from a portion corresponding to the contact portion 20 to a portion corresponding to the leading end portion 30. A length W50*a* illustrated in FIG. 6 is greater than a length W50*b*. The length W50*a* is the maximum length, in the X direction, of a portion of the penetration hole 50A that corresponds to the leading end portion 30. The length W50*b* is a length, in the X direction, of a portion of the penetration hole 50A that corresponds to an end portion 71*e*A of the first inclination portion 71A in the −Z direction.

As illustrated in FIG. 6, the first inclination portion 71A includes a portion of which the length in the X direction increases in the +Z direction. That is, the length, in the X direction, of at least part of the first inclination portion 71A increases in the +Z direction. The end portion 71*e*A of the first inclination portion 71A is disposed in the +Z direction relative to the end portion 23*e* of the reduced portion 23.

As illustrated in FIG. 6, the press-fit terminal 100A includes two first inclination portions 71A. One of the first inclination portions 71A is disposed on one side in the X direction relative to the penetration hole 50A. The other one of the first inclination portions 71A is disposed on the other side in the X direction relative to the penetration hole 50A. That is, the first inclination portions 71A are each disposed on a corresponding one of both sides of the penetration hole 50A in the X direction. The two first inclination portions 71A are coupled to each other at a position located in the +Z direction relative to the penetration hole 50A.

As described above, in the press-fit terminal 100A according to the first modified example, the maximum length W50*a*, in the width direction (X direction), of a portion of the penetration hole 50A that corresponds to the leading end portion 30 is greater than the length W50*b*, in the width direction (X direction), of a portion of the penetration hole 50A that corresponds to the end portion 71*e*A of the first inclination portion 71 on the base portion 10 side. This makes it easier to reduce the rigidity of the press-fit terminal 100A at the time of insertion into the through hole 201. Thus, the press-fit terminal 100A according to the first modified example can further reduce the force acting on the through hole 201 at the time of insertion.

Second Modified Example

Figure 7:
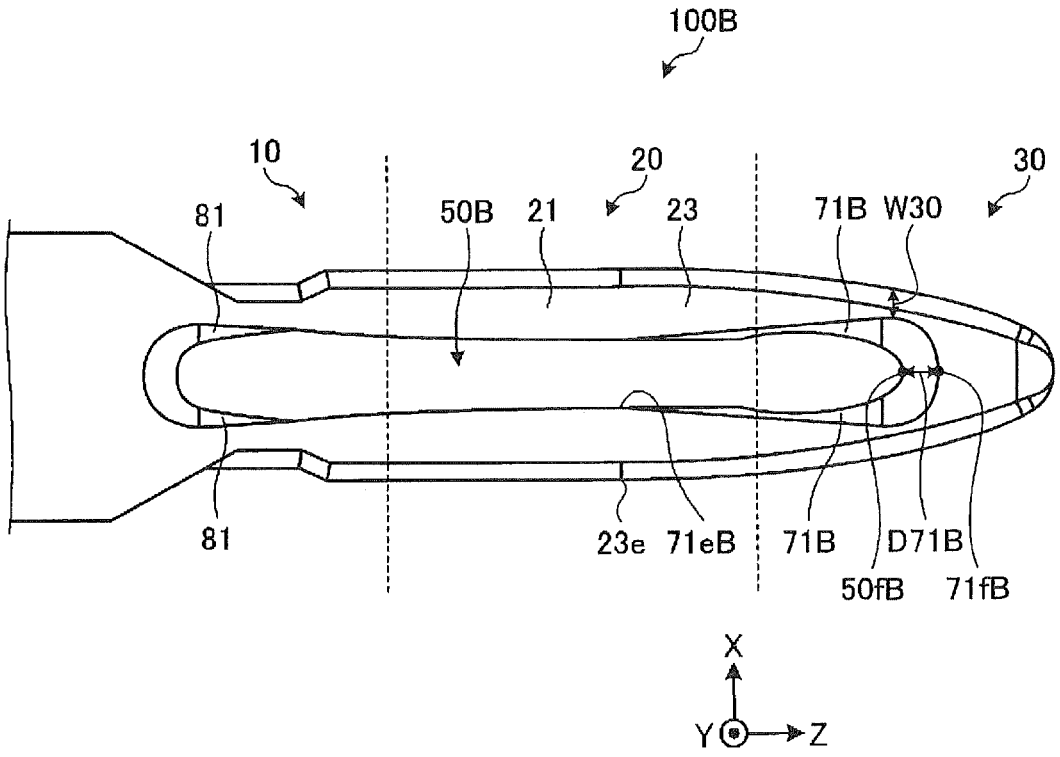
FIG. 7 is a front view of a press-fit terminal according to a second modified example.

FIG. 7 is a front view of a press-fit terminal according to a second modified example. The dotted line in FIG. 7 indicates the position of a front surface of a substrate 200. Note that the same reference characters are attached to constituent elements that are the same as those described in the embodiment described above, and explanation thereof will not be repeated.

As illustrated in FIG. 7, a press-fit terminal 100B according to the second modified example includes a penetration hole 50B and a first inclination portion 71B. The first inclination portion 71B includes a portion of which the length in the X direction increases in the +Z direction. That is, the length, in the X direction, of at least part of the first inclination portion 71B increases in the +Z direction. An end portion 71*e*B of the first inclination portion 71B in the −Z direction is disposed at the same position in the Z direction as the end portion 23*e* of the reduced portion 23 of the contact portion 20 in the −Z direction.

As illustrated in FIG. 7, the press-fit terminal 100B includes two first inclination portions 71B. One of the first inclination portions 71B is disposed on one side of the penetration hole 50B in the X direction. The other one of the first inclination portions 71B is disposed on the other side of the penetration hole 50B in the X direction. That is, the first inclination portions 71B are each disposed on a corresponding one of both sides of the penetration hole 50B in the X direction. The two first inclination portions 71B are coupled to each other at a position located in the +Z direction relative to the penetration hole 50B.

As illustrated in FIG. 7, a distance D71B is greater than a length W30. The distance D71B is a distance from the leading end 50*f*B of the penetration hole 50B in the +Z direction to the leading end 71*f*B of the first inclination portion 71B in the +Z direction. The length W30 is the minimum length of the leading end portion 30 in the X direction.

As described above, in the press-fit terminal 100B according to the second modified example, the distance D71B from the leading end 50*f*B of the penetration hole 50B in the insertion direction (+Z direction) to the leading end 71*f*B of the first inclination portion 71B in the insertion direction (+Z direction) is greater than the minimum length W30 of the leading end portion 30 in the width direction (X direction). This makes it easier to reduce the rigidity of the press-fit terminal 100B at the time of insertion into the through hole 201. Thus, the press-fit terminal 100B according to the second modified example can further reduce the force acting on the through hole 201 at the time of insertion.

Third Modified Example

Figure 8:
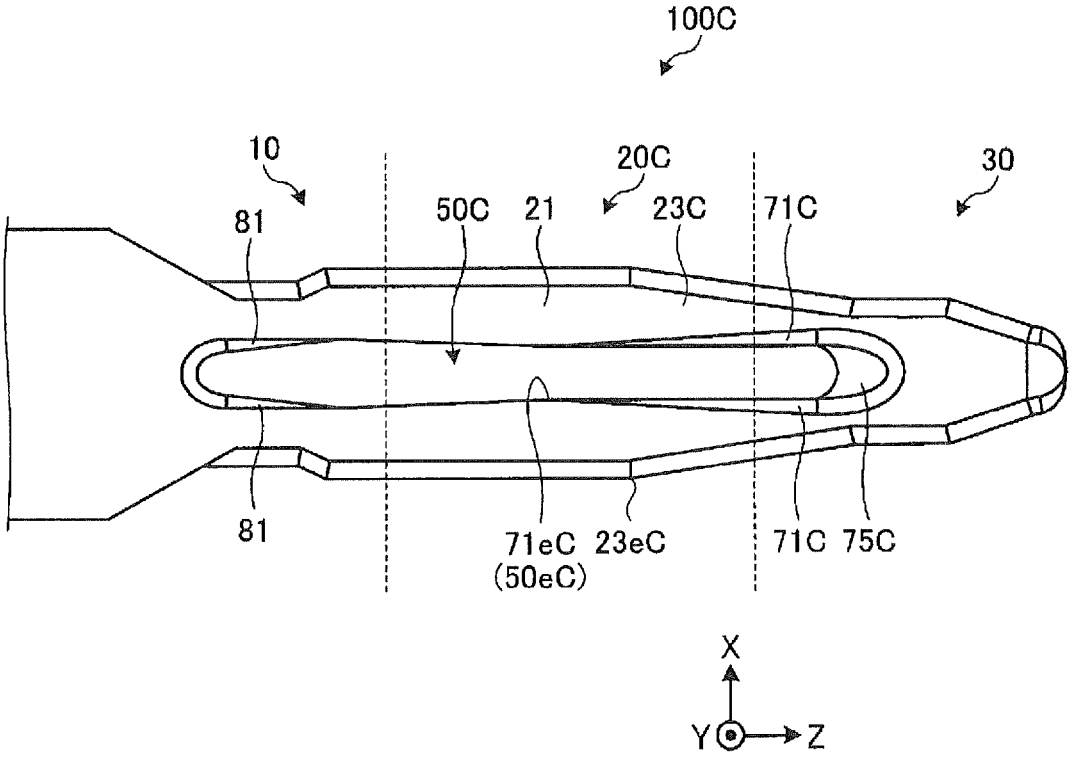
FIG. 8 is a front view of a press-fit terminal according to a third modified example.

FIG. 8 is a front view of a press-fit terminal according to a third modified example. The dotted line in FIG. 8 indicates the position of the front surface of a substrate 200. Note that the same reference characters are attached to constituent elements that are the same as those described in the embodiment described above, and explanation thereof will not be repeated.

As illustrated in FIG. 8, a press-fit terminal 100C according to the third modified example includes a contact portion 20C, a penetration hole 50C, a first inclination portion 71C, and a thin portion 75C. The contact portion 20C includes a reduced portion 23C. The reduced portion 23C is disposed in the +Z direction relative to the main body portion 21. The length of the reduced portion 23C in the X direction decreases in the +Z direction. The outer peripheral surface of the reduced portion 23C has a planar shape. The outer edge of the reduced portion 23C traces a straight line in an XZ plan view (as viewed from the Y direction).

An end portion 71*e*C of the first inclination portion 71C is disposed in the −Z direction relative to an end portion 23*e*C of the reduced portion 23C in the −Z direction. The position of the end portion 71*e*C in the Z direction is equal to the position of a bent portion 50*e*C of the penetration hole 50C in the Z direction.

As described above, in the press-fit terminal 100C according to the third modified example, the outer peripheral surface of the reduced portion 23C has a planar shape. This stabilizes the orientation of the press-fit terminal 100C when the press-fit terminal 100C is inserted into the through hole 201. The press-fit terminal 100C can reduce the likelihood of the press-fit terminal 100C falling over (inclination relative to the Z axis) at the time of insertion into the through hole 201.

Fourth Modified Example

Figure 9:
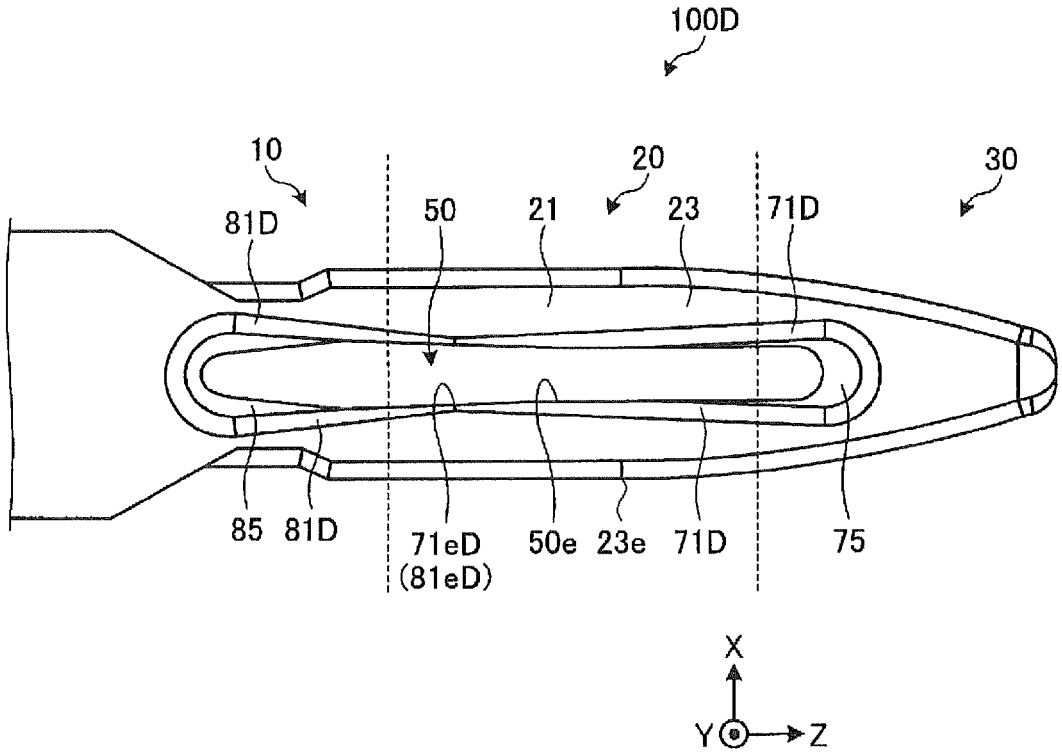
FIG. 9 is a front view of a press-fit terminal according to a fourth modified example.

FIG. 9 is a front view of a press-fit terminal according to a fourth modified example. The dotted line in FIG. 9 indicates the position of a front surface of a substrate 200. Note that the same reference characters are attached to constituent elements that are the same as those described in the embodiment described above, and explanation thereof will not be repeated.

As illustrated in FIG. 9, the press-fit terminal 100D according to the fourth modified example includes a first inclination portion 71D, a second inclination portion 81D, and a thin portion 85. An end portion 71*e*D of the first inclination portion 71D in the −Z direction is coupled to an end portion 81*e*D of the second inclination portion 81D in the +Z direction. The end portion 71*e*D (the end portion 81*e*D of the second inclination portion 81D) of the first inclination portion 71D is disposed in the contact portion 20. The end portion 71*e*D of the first inclination portion 71D is disposed in the +Z direction relative to the end portion of the contact portion 20 in the −Z direction. The end portion 71*e*D of the first inclination portion 71D is disposed in the −Z direction relative to the end portion 23*e* of the reduced portion 23 in the −Z direction. The end portion 71*e*D of the first inclination portion 71D is disposed at the same position as the bent portion 50*e* of the penetration hole 50, or is disposed in the −Z direction relative to the bent portion 50*e*. The periphery of the penetration hole 50 is entirely surrounded by the first inclination portion 71D and the second inclination portion 81D. The first inclination portion 71D and the second inclination portion 81D are formed continuous over the entire length of the outer periphery of the penetration hole 50.

As illustrated in FIG. 9, the thin portion 85 is disposed between the end portion of the penetration hole 50 in the −Z direction and the second inclination portion 81D. That is, the thin portion 85 is disposed on the inner side of the second inclination portion 81D. The thickness of the thin portion 85 in the Y direction is smaller than the thickness of the base portion 10 in the Y direction. The thickness of the thin portion 85 is constant. The thin portion 85 includes a front surface parallel to the XZ plane.

As described above, in the press-fit terminal 100D according to the fourth modified example, the end portion 71*e*D of the first inclination portion 71D on the base portion 10 side is coupled to the end portion 81*e*D of the second inclination portion 81D on the leading end portion 30 side. This enables the press-fit terminal 100D according to the fourth modified example to prevent the end portion 71*e*D of the first inclination portion 71D as well as the end portion 81*e*D of the second inclination portion 81D, from becoming a starting point for cracks or the like. Furthermore, this further facilitates adjustment of the insertion force at the time of inserting the press-fit terminal 100D into the through hole 201 and also of the retention force of the press-fit terminal 100D relative to the through hole 201.

REFERENCE SIGNS LIST

10 Base portion
20, 20C Contact portion
21 Main body portion
23, 23C Reduced portion
23*e*, 23*e*C End portion
30 Leading end portion
50, 50A, 50B, 50C Penetration hole
50*e*, 50*e*C Bent portion
50*f*B Leading end
71, 71A, 71B, 71C, 71D First inclination portion
71*e*, 71*e*A, 71*e*B, 71*e*C, 71*e*D End portion
71*f*B Leading end
75, 75C Thin portion
81, 81D Second inclination portion
81*e*, 81*e*D End portion
85 Thin portion
100, 100A, 100B, 100C, 100D Press-fit terminal
200 Substrate
201 Through hole

The invention claimed is:

1. A press-fit terminal comprising:
a contact portion that is to be in contact with an inner wall of a through hole provided in a substrate;
a leading end portion disposed on a leading end side relative to the contact portion in an insertion direction toward the through hole;
a base portion disposed on an opposite side to the leading end portion with the contact portion being interposed between the leading end portion and the base portion;
a penetration hole provided across the base portion, from the contact portion to the leading end portion, and comprising an inner wall; and
a part of the inner wall comprising a first inclination portion provided across the contact portion and the leading end portion, wherein
the first inclination portion is inclined toward the penetration hole, and
a length, in a width direction, of at least part of the first inclination portion increases toward a leading end of the leading end portion, the width direction being orthogonal to the insertion direction and a penetration direction of the penetration hole.

2. The press-fit terminal according to claim 1, wherein
an end portion of the first inclination portion on a side of the base portion is disposed on a side of the leading end portion relative to an end portion of the contact portion on a side of the base portion.

3. The press-fit terminal according to claim 1, wherein
the contact portion comprises:
a main body portion of which a length in the width direction is constant; and
a reduced portion disposed on a side of the leading end portion relative to the main body portion and having a length in the width direction decreasing toward the leading end portion.

4. The press-fit terminal according to claim 3, wherein
an end portion of the first inclination portion on a side of the base portion is disposed on a side of the base portion relative to an end portion of the reduced portion on a side of the base portion.

5. The press-fit terminal according to claim 3, wherein
an outer peripheral surface of the reduced portion has a planar shape.

6. The press-fit terminal according to claim 1, wherein
the first inclination portion is disposed on each of both sides of the penetration hole in the width direction, and
two of the first inclination portions are coupled at the leading end portion.

7. The press-fit terminal according to claim 1, further comprising:
a thin portion disposed between an end portion of the penetration hole in the insertion direction and the first inclination portion, wherein
a thickness of the thin portion in the penetration direction is smaller than a thickness of the leading end portion in the penetration direction.

8. The press-fit terminal according to claim 6, wherein
a distance from a leading end of the penetration hole in the insertion direction to a leading end of the first inclination portion in the insertion direction is greater than a minimum length of the leading end portion in the width direction.

9. The press-fit terminal according to claim 1, further comprising:
a second inclination portion provided across the contact portion and the base portion and disposed continuous at an outer periphery of the penetration hole, wherein
the second inclination portion is inclined toward the penetration hole, and
a length of the second inclination portion in the width direction increases in a direction opposite to a direction toward a leading end of the leading end portion.

10. The press-fit terminal according to claim 9, wherein
the second inclination portion is disposed on each of both sides of the penetration hole in the width direction, and
two of the second inclination portions are coupled at the base portion.

11. The press-fit terminal according to claim 9, wherein
an end portion of the first inclination portion on a side of the base portion is coupled to an end portion of the second inclination portion on a side of the leading end portion.

12. The press-fit terminal according to claim 1, wherein
a maximum length, in the width direction, of a portion of the penetration hole that corresponds to the leading end portion is greater than a length, in the width direction, of a portion of the penetration hole that corresponds to an end portion of the first inclination portion on a side of the base portion.

* * * * *